United States Patent [19]

Baldwin

[11] 4,256,697

[45] Mar. 17, 1981

[54] BLOOD INCUBATOR DEVICE

[76] Inventor: Fred Baldwin, c/o Cryosan, Inc., 850 Providence Hwy., P.O. Box 351, Dedham, Mass. 02026

[21] Appl. No.: 971,653

[22] Filed: Dec. 21, 1978

[51] Int. Cl.[3] ..... B01L 7/02

[52] U.S. Cl. ..... 422/104; 219/433; 219/535; 422/73; 422/102; 435/809

[58] Field of Search ..... 422/102, 104, 73; 435/287, 296, 299, 809; 219/433, 521, 437, 535

[56] References Cited

U.S. PATENT DOCUMENTS

| | | | |
|---|---|---|---|
| 2,793,278 | 5/1957 | Anderson | 219/521 X |
| 3,294,039 | 12/1966 | Ogden | 219/462 |
| 3,607,134 | 9/1971 | McIntyre | 422/104 |
| 3,764,780 | 10/1973 | Ellis | 219/521 X |
| 3,940,249 | 2/1976 | McClurg | 422/104 X |
| 4,026,671 | 5/1977 | Simons | 422/73 |

*Primary Examiner*—Michael S. Marcus
*Attorney, Agent, or Firm*—Wolf, Greenfield & Sacks

[57] ABSTRACT

A blood sample incubation device to maintain a blood sample or the like at a fixed temperature receives a test tube bearing the sample in a flexible, elastic, eversible finger-like sleeve which surrounds the test tube and grips the exterior surface of the test tube completely about its outer surface. The sleeve is mounted within a well formed in a heater block and the well contains a heat conductive fluid. In operation, the tube or cuvet filled with the sample is inserted into the sleeve which is surrounded by the fluid within the well so that heat may pass from the block through the fluid to the test tube and blood sample. When the test tube is removed, it draws the sleeve with it to cause the sleeve to evert and protrude upwardly from the heater block to a position in which the sleeve is ready to receive the next test tube.

6 Claims, 4 Drawing Figures

BLOOD INCUBATOR DEVICE

BACKGROUND OF THE INVENTION

This invention relates to the incubation of blood samples and, particularly, to an improved incubation device for maintaining blood samples at constant temperature for a predetermined period of time in preparation for blood cross-matching, enzyme reactions, colorimetric determinations and like routine blood sampling procedures. Among the typical traditional techniques for incubating blood samples has been simply to immerse the test tube or cuvet in a temperature controlled water bath. Although the water bath technique provides accurate control over the temperature of the blood sample, it has presented a number of inconveniences and difficulties which have led to the use of dry heating techniques. Perhaps among the more inconvenient features of the water bath technique is that when the test tube is withdrawn from the bath, water film and/or droplets on the test tube may interfere with subsequent optical tests on the blood sample. It is necessary for technicians to wipe the test tubes dry, and this can become quite a time consuming procedure, particularly in those environments where large masses of blood samples are being tested at the same time. In general, the water baths tend to be somewhat messy.

In order to avoid these difficulties, there has been a trend toward the use of "dry bath" techniques which have, in large part, replaced the traditional water bath for most routine blood testing applications. Typically, the dry baths consist of a heated block having drilled holes receptive to the test tubes. This technique provides other difficulties. For example, it is virtually impossible to assure full and intimate heat transfer contact between the holes in the heater block and the test tubes. Rather, the test tube tends to contact the heater at a number of points, which tends to develop hot spots. Much of the surface of the test tube is spaced from the surface of the heater block by a thin layer of air which accentuates the undesirable localized heating tendency. Often, the dry devices are operated at too hot a temperature in order to compensate for the non-uniform heat transfer effect. This can lead to short life for the device. Also among the difficulties presented with the dry bath devices is that the optical cuvet may become scratched along insertion and/or removal from the heater socket. This is highly undesirable because small scratches will scatter light when the cuvet is placed in a spectrophotometer in subsequent optical tests. Notwithstanding these difficulties, dry bath techniques are tending to replace the wet bath techniques because of the fewer manipulative steps required. This is a particularly important factor in mass blood testing procedures.

Also among the techniques which have been suggested in the prior art is to use a forced hot air type of incubator. This suffers from the difficulty that there is a severe time/temperature lag which is undesirable, particularly in mass testing environments.

It is among the general objects of the invention to provide a blood incubation device which overcomes the difficulties presented by the presently available systems.

SUMMARY OF THE INVENTION

The incubator of the present invention employs a heater block having one or more chambers, each of which contains a suitable heat transfer fluid, such as water. Each chamber is closed, at its upper end, by a finger-like sleeve which is receptive to an inserted test tube and which normally extends downwardly into the chamber and is surrounded by the heat conductive liquid in the chamber. The sleeve is formed from thin, flexible and resilient material having good heat transfer properties. The dimensions of the sleeve are such that for a substantial range of test tube sizes, the sleeve will be sufficiently resilient to grip the outer surface of the test tube and surround it in full intimate surface contact. The test tube may be removed simply by withdrawing it upwardly and out of the chamber. The sleeve may tend to be drawn outwardly with the test tube to an everted configuration and will be receptive to the next test tube to be inserted. The foregoing arrangement assures that there will be full and intimate surface area contact to promote rapid and uniform heat transfer, without establishing hot spots or thermal gradients. The nature of the material of the sleeve and the manner in which it peels away from the test tube when withdrawn assures that the tube will not be scratched, and also assures that the tube will be dry when withdrawn.

In another embodiment of the invention, the sleeve may be attached to a cup-like insert to define a sealed unit which is removable in its entirety from a suitable socket formed in the heater block.

It is among the general objects of the invention to provide an incubation device which provides all of the heat transfer advantages of the wet bath system yet which avoids its difficulties.

Another object of the invention is to provide an incubator device of the type described which will not damage the optical qualities of the test tube.

A further object of the invention is to provide a device of the type described which avoids the development of hot spots and thermal gradients.

A further object of the invention is to provide a device of the type described in which the thermal response is rapid.

Another object of the invention is to provide a device of the type described which is of simple and economical construction.

Still another object of the invention is to provide a device of the type described which can accommodate a variety of test tube sizes and cross sectional shapes.

DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENT

Figure 1:
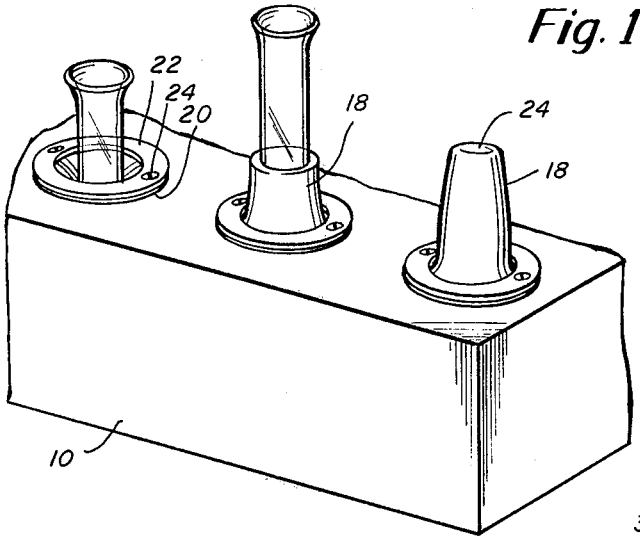
FIG. 1 is an illustration of a portion of a multi-tube incubator device showing one test tube fully inserted, another partly withdrawn and a third configuration in which the sleeve has been everted.
Figure 2:
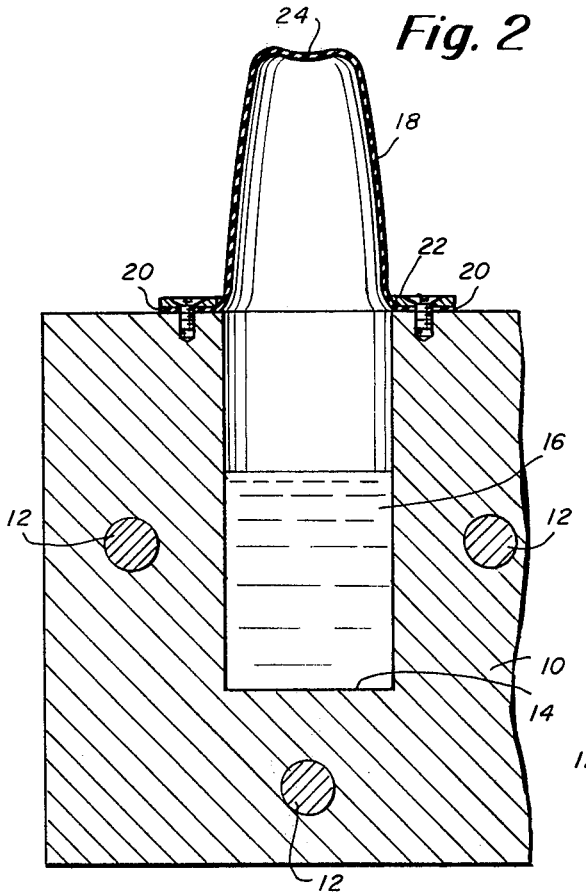
FIG. 2 is a side elevation, in section, of an incubator chamber with the sleeve everted.
Figure 3:
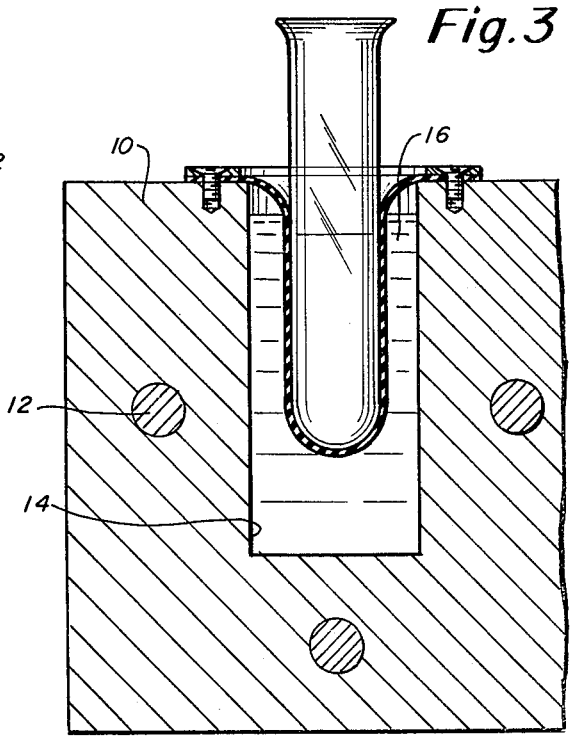
FIG. 3 is an illustration of the device of FIG. 2 with a test tube inserted in the device.

FIGS. 1–3 illustrate one embodiment of the invention which includes a metallic heater block 10 formed from a metal having high thermal conductivity, such as aluminum. The block 10 is heated, for example, by a plurality of heater rods 12 which may be inserted into suitably formed holes in the block, or by other well-known types of heaters. The block 10 is formed with a plurality of sockets or chambers 14, each of which is filled with suitable liquid having good heat transfer properties, such as water, indicated at 16. As shown, the chamber is not filled fully with water for reasons which will be apparent. The upper end of the chamber 14 is enclosed by a resilient, flexible and elastic finger-like sleeve 18 which can protrude downwardly into the chamber 14 to be immersed in the water 16 (as shown in FIG. 3) or may protrude outwardly in an everted configuration as suggested in FIG. 2. The sleeve 18 preferably is formed with a peripheral flange 20 at its upper end (as seen in FIG. 3) and is secured to the upper surface of the block 10 by a ring 22 which may be fastened to the block 10 by screws 24.

The sleeve 18 may be formed from any of a variety suitably flexible, resilient and elastic materials such as an appropriate latex, plastic or silicone rubber material. The length and cross sectional dimensions of the sleeve 18 are selected so that the sleeve will be capable of stretching somewhat to accommodate the test tubes thus assuring that when a test tube is received within a sleeve, the sleeve 18 will surround and engage the outer surface of the tube in full intimate surface contact. As mentioned, this avoids the formation of hot spots and thermal gradients which has been among the difficulties presented in the prior dry incubation techniques. It should be noted that the resilience and elasticity of the sleeve will enable it to conform to the contour of a variety of test tube shapes, including test tubes having circular cross sections as well as test tubes having square cross sections or other non-circular configurations.

When a test tube is inserted into a device, as indicated in FIG. 3, the main portion of the tube which contains the blood will be contained wholly and intimately by the surrounding sleeve which, in turn, is wholly immersed in the heat transfer liquid. The high thermal conductivity of the block 10 assures that heat will be transferred to the liquid uniformly and that the heat will be transferred to the blood sample through the sleeve and test tube wall, all in a uniform manner, without hot spots or thermal gradients and in a manner, which maintains the exterior of the test tube in a completely dry condition. As the tube is removed (as indicated at the middle position in FIG. 1) the sleeve 18 also will be drawn outwardly with the tube, and will progressively peel away from the tube while assuming an everted configuration shown at the right in FIG. 1. The blood sample then may be immediately put through optical or other tests without requiring wiping of the test tube or other manipulations which typically have been required by the prior wet bath techniques. Moreover, the nature of the material from which the sleeve 18 is formed as well as the tendency for the sleeve 18 to unroll and peel away from the tube as the tube is withdrawn eliminates the possibility of the tube becoming scratched. The everted sleeve 18 then is ready to receive another test tube sample.

If desired, the closed end of the sleeve may be formed with a concave, dimpled configuration indicated at 24 in order to facilitate registry and engagement of the bottom of a test tube when it is inserted. Insertion of the test tube simply requires engagement with the bottom of the tube in the dimpled portion 24 and then axial insertion of the tube downwardly. The sleeve 18 will tend to roll onto the exterior surface of the test tube in a manner opposite to the peeling-off effect described above in connection with withdrawal of the previous tube.

Figure 4:
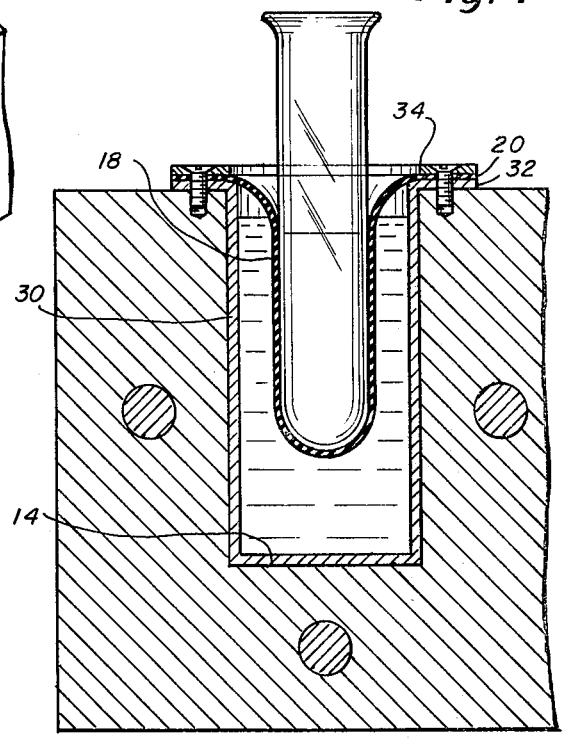
FIG. 4 is an illustration of an alternate embodiment of the invention.

FIG. 4 illustrates an alternate embodiment of the invention in which the cavity 14 receives a removable cup-like insert to which the sleeve 18 is secured and which includes a self-contained volume of heat conducting fluid. In this embodiment, the external configuration of the cup 30 should closely match the configuration of the cavity 14, which may be flat-bottomed. The upper end of the cup 30 is provided with a peripheral flange 32 which cooperates with a ring 34 to securely grip the peripheral margin 20 of the sleeve 18. The ring 34 is secured to the flange 32 by any appropriate means. The unit of the cup, fluid and sleeve 18 may be removed from the block 10 or may be replaced as desired. Operation of the device and insertion and removal of the test tube is identical to that of the first described embodiment. It should be noted that where the embodiment employing the cup is used, it may be desirable to coat the facing surfaces of the cup 30 and cavity 14 with a conductive grease or other lubricant (such as a silicone grease) in order to assure good and uniform heat transfer from the block to the heat conductive fluid.

It should be noted that although the invention has been described as utilizing water as a fluid coupling medium, other fluid or fluent coupling mediums may be employed such as, for example, an organic liquid, silicone fluid or powdered solids.

Suitable thermostatic controls may be employed in connection with the device to control the temperature as desired.

From the foregoing it will be appreciated that the present invention overcomes the difficulties presented in the prior art wet and dry techniques. More particularly, it results in a system which will not scratch or otherwise adversely effect the optical qualities of the test tube or cuvet. A system is provided by which heat transfer is uniform without hot spots or thermal gradients and where the heat transfer is effected in a manner which provides minimum time/temperature lag. As a result, the incubation may be effected rapidly and with accuracy and in a manner which is far more convenient than is available with currently employed techniques and devices. The invention lends itself to use in mass testing techniques.

It should be understood that the foregoing description of the invention is intended merely to be illustrative thereof and that other embodiments and modifications may be apparent to those skilled in the art without departing from its spirit.

Having thus described the invention, what I desire to claim and secure by Letters Patent is:

1. A test tube incubation device comprising:

a test tube of predetermined cross-sectional dimensions;

a heater block having at least one cavity formed therein;

an elongate, finger-like sleeve having an open end and a closed end, the open end of the sleeve being secured with respect to the heater block in the region of the open end of the cavity, the sleeve being formed from a resilient, flexible material displaying good heat transfer properties, the sleeve extending into the cavity to define an externally exposed pocket receptive to said test tube and defining, in cooperation with the cavity, an enclosed interior chamber adapted to contain a fluent heat transfer medium, said sleeve being of cross-sectional dimensions with respect to said test tube as to effect a circumferential grip on the test tube when the test tube is received within the sleeve;

the sleeve being eversible between said position in which it extends into the interior of the cavity and an everted position in which it projects outwardly of the cavity;

said sleeve being so constructed and arranged so that upon withdrawal of said test tube from said pocket the sleeve will be drawn by the test tube toward said everted position and will peel away from the test tube as it is drawn to its everted position; and a concave dimple formed at the closed end of the sleeve.

2. A device as defined in claim 1 further comprising a cup having an open, upper end, the cup being dimensioned to be received within the cavity of the heater block;

the open end of the sleeve being attached to the open end of the cup;

the interior chamber defined between the sleeve and the cup being filled with a fluent heat transfer medium.

3. An incubation device as defined in claim 1 wherein the open end of the sleeve is formed to include a radially and outwardly extending flange portion surrounding the open end of the sleeve, the sleeve being attached to the heater block by the flange.

4. A device as defined in claim 2 wherein the open end of the sleeve is formed to include a radially and outwardly extending flange which surrounds the open end of the sleeve, the sleeve being attached to the open end of the cup by the flange.

5. A device as defined in claim 1 further comprising thermostatic control means operatively associated with the heater block.

6. A device as defined in claim 1 further comprising a fluent material disposed within the cavity in surrounding relation to the sleeve.

* * * * *